US008419225B2

(12) United States Patent
Zeng et al.

(10) Patent No.: US 8,419,225 B2
(45) Date of Patent: Apr. 16, 2013

(54) MODULAR LIGHT EMITTING DIODE (LED) LAMP

(75) Inventors: Yichong Zeng, Chelmsford, MA (US); Shiyong Zhang, Acton, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 92 days.

(21) Appl. No.: 13/235,552

(22) Filed: Sep. 19, 2011

(65) Prior Publication Data

US 2013/0070454 A1 Mar. 21, 2013

(51) Int. Cl.
*F21V 29/00* (2006.01)

(52) U.S. Cl.
USPC ..... 362/294; 362/373; 362/249.02; 362/231

(58) Field of Classification Search ..... 362/294, 362/373, 231, 249.02
See application file for complete search history.

(56) References Cited

U.S. PATENT DOCUMENTS

| | | | | |
|---|---|---|---|---|
| 4,840,222 | A | 6/1989 | Lakin et al. | |
| 6,598,996 | B1 * | 7/2003 | Lodhie | 362/249.05 |
| 6,715,900 | B2 | 4/2004 | Zhang | |
| 6,787,999 | B2 | 9/2004 | Stimac et al. | |
| 7,549,786 | B2 | 6/2009 | Higley et al. | |
| 7,679,096 | B1 | 3/2010 | Ruffin | |
| 7,819,562 | B2 | 10/2010 | Freeman et al. | |
| 7,850,361 | B2 | 12/2010 | Yu | |
| 7,883,261 | B2 | 2/2011 | Yu | |
| 7,959,332 | B2 | 6/2011 | Tickner et al. | |
| 8,018,136 | B2 | 9/2011 | Gingrich, III et al. | |
| 8,322,896 | B2 * | 12/2012 | Falicoff et al. | 362/363 |
| 2004/0189218 | A1 * | 9/2004 | Leong et al. | 315/291 |
| 2009/0161356 | A1 * | 6/2009 | Negley et al. | 362/231 |
| 2009/0268447 | A1 | 10/2009 | Zhang | |
| 2009/0279308 | A1 | 11/2009 | Veiga et al. | |
| 2010/0141153 | A1 * | 6/2010 | Recker et al. | 315/149 |
| 2011/0089838 | A1 * | 4/2011 | Pickard et al. | 315/113 |

* cited by examiner

*Primary Examiner* — Ali Alavi
(74) *Attorney, Agent, or Firm* — Edward S. Podszus

(57) ABSTRACT

An LED lamp (10) includes a heat sink (12), an electrical interconnector (18), an electronics module (16), and a light module (14). The electrical interconnector (18) is disposed in a passageway (32) extending between first and second regions (24, 26) of the heat sink (12) and includes contacts (66) exposed within the first and second regions (24, 26). The electronics module (16) is adapted to be selectively attached within the first region (24) and includes a first electrical connector (64). The light module (14) is adapted to be selectively attached within the second region (26) and includes at least one light emitting diode (LED) (34) and a second electrical connector (38). The first and second electrical connectors (64, 38) are adapted to selectively form an electrical connections to the contacts (66) to provide power from a power source to the LED (34) of the lighting module (14).

15 Claims, 14 Drawing Sheets

MODULAR LIGHT EMITTING DIODE (LED) LAMP

CROSS-REFERENCE TO RELATED APPLICATIONS

Not applicable.

FIELD

The present application relates to light emitting diode (LED)-based light sources, and in particular to a modular retrofit LED lamp.

BACKGROUND

A light emitting diode (LED) lamp utilizes one or more LEDs as a source of illumination. LED lamps provide numerous benefits including, but not limited, increased efficiency and lifespan. The known LED lamps feature a printed circuit board (PCB), having one or more LEDs, which is permanently secured to a heat sink. As such, the PCB (and therefore LEDs) cannot be removed from the heat sink without damaging the connection leads of the PCB, and thereby rendering the entire LED lamp unsuited for its intended purpose. One reason that the PCB was permanently secured to the heat sink is that it was believed to be necessary in order to ensure sufficient heat transfer from the PCB to the heat sink. In other cases, LEDs are mounted permanently directly to a heat sink and leads from the LED soldered permanently to a PCB.

For example, U.S. Pat. No. 6,787,999 (Stimac et al.), assigned to GELcore, discloses an electronics module (14) releasably attached to a heat sink (22) and a LED module (20) attached to the heat sink (22) with electrical leads arranged in an electrical conduit (40) and a separate lens system (26) held by clips to a surface (24) of the heat sink (22). In such prior art devices, it is known to have the LED module permanently attached such as by soldering, such that once assembled it cannot be non-destructively removed from the heat sink (22).

U.S. Pat. No. 7,959,332 (Tickner et al.), assigned to Cooper Technologies Company, discloses an integrated LED and optic (with heat sink) that make module connection via a jack to an in-ceiling canister (which conventionally are also known to contain heat-sink features of their own).

U.S. Pat. No. 4,840,222 (Lakin et al.), assigned to Fasco Industries, Inc., discloses a heat sink and mounting arrangement. With reference to FIG. 11 and the abstract thereof, Lakin discloses an access hole in the side of the conduit box and aligned with a channel that permits a pin to be inserted therethrough to push tabs out of the channel and release the heat sink and PC board from the conduit box.

U.S. Patent Publication 2009/0268447 (Zhang), assigned to PCE Industry, Inc., discloses a LED lamp having screws connecting the LED module 40 to the heat sink 30 (see, for example, FIG. 2).

Other types of lamps include HID lamps as described in U.S. Pat. No. 7,819,562 to Freeman, et al. and U.S. Patent Publication No. 2009/0279308 to Veiga, et al., both of which are assigned to Osram Sylvania Inc, assignee of the instant disclosure.

BRIEF DESCRIPTION OF THE DRAWINGS

Reference should be made to the following detailed description which should be read in conjunction with the following figures, wherein like numerals represent like parts.

For a thorough understanding of the present disclosure, reference should be made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION

Figure 1A:
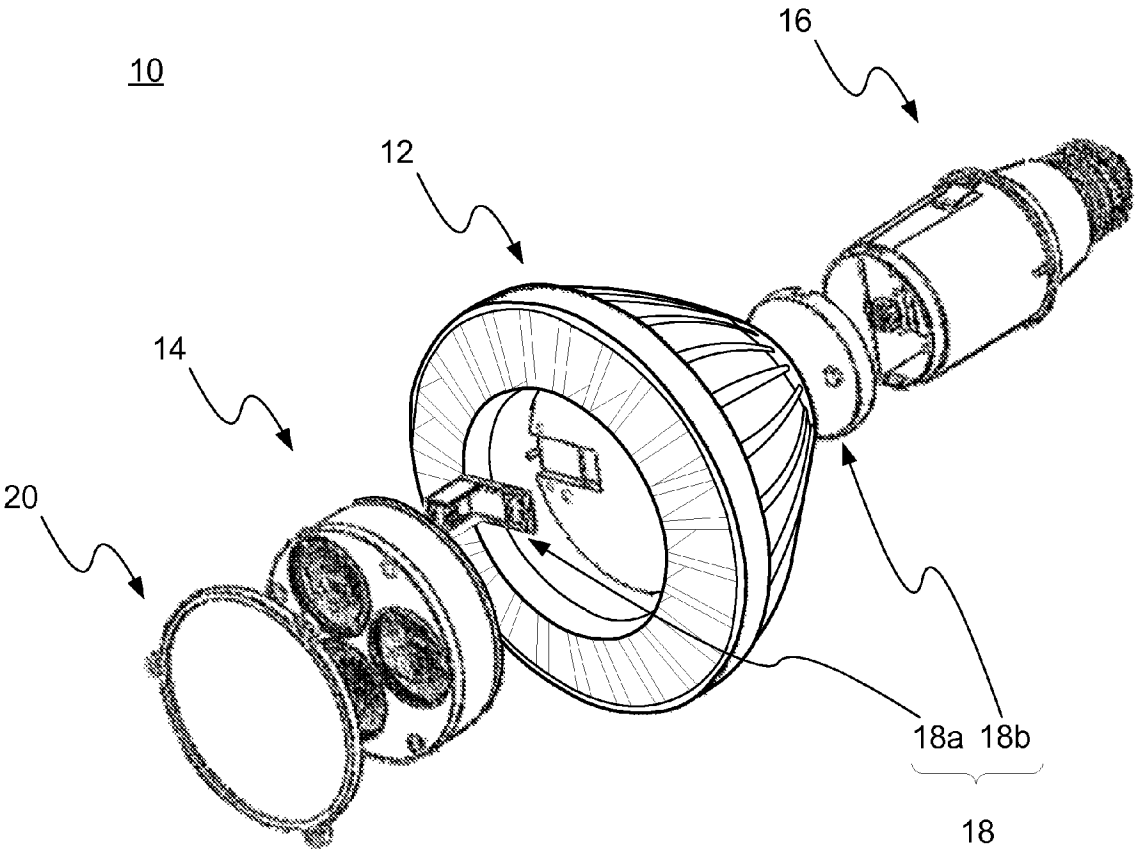
FIGS. 1A and 1B generally illustrate an exploded view of one embodiment of a LED lamp consistent with the present disclosure.
Figure 1B:
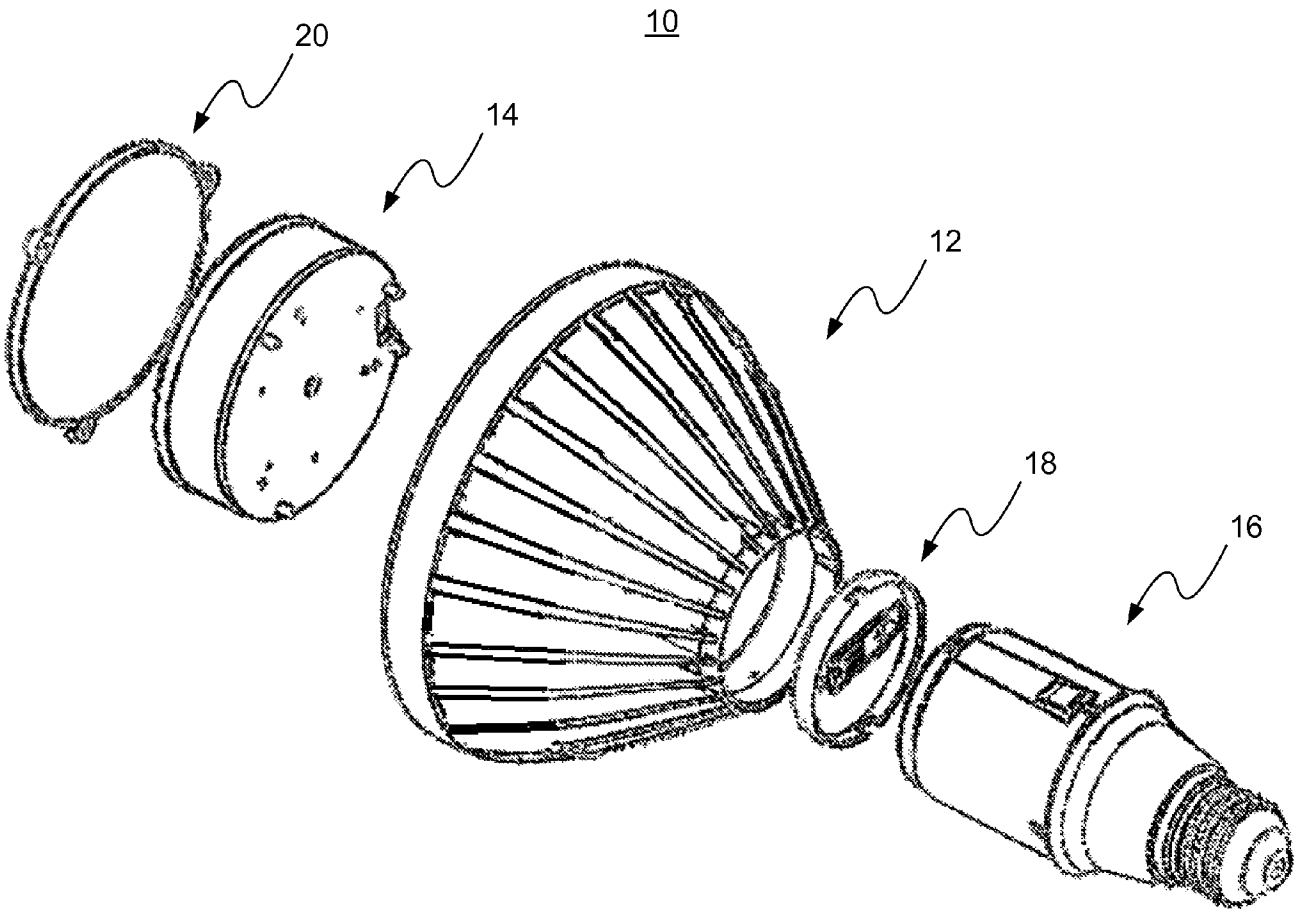
Figure 2:
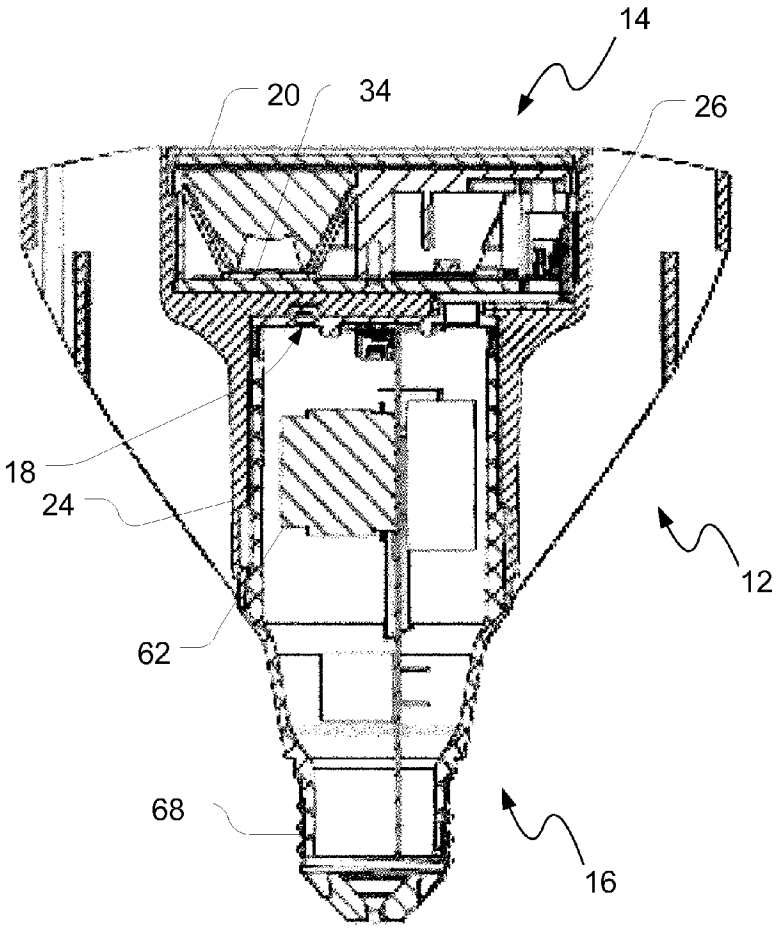
FIG. 2 generally illustrates a cross-sectional view of one embodiment of the LED lamp of FIG. 1 in an assembled state.

Turning now to the figures, FIGS. 1A and 1B generally illustrate an exploded view of one embodiment of a LED lamp 10 and FIG. 2 generally illustrates a cross-sectional view of one embodiment of an assembled LED lamp 10. The LED lamp 10 generally includes a heat sink 12, a light module 14, an electronics module 16, and an electrical interconnector 18. As explained herein, the electrical interconnector 18 may include one or more components (e.g., 18*a* and 18*b*), which for convenience may be considered collectively as electrical interconnector 18. By way of a brief overview, the light module 14 and electronics module 16 are configured to be selectively attached and detached with the heat sink 12. The electrical interconnector 18 is configured to electrically couple the light module 14 and the electronics module 16 when the LED lamp 10 is assembled. The LED lamp 10 may optionally include an optical cover 20, which may be removably secured to the heat sink 12. The optical cover 20 may function as a diffuser and/or protect the light module 14.

As will be apparent from the following description, a LED lamp 10 consistent with one or more embodiments of the present disclosure may provide numerous advantages. For example, the modular nature of the LED lamp 10 allows any one of the components (e.g., heat sink 12, light module 14, electronics module 16, and/or electrical interconnector 18) to be easily replaced by a user to either repair or modify the LED lamp 10 to perform a different function. Another advantage of the LED lamp 10 is that the LED lamp 10 may be easily recycled. For example, the heat sink 12 includes approximately 400 grams of aluminum. Because the heat sink 12 may be easily removed from the remaining components, the heat sink 12 may be easily recycled. The module nature of the LED lamp 10 may also increase the design flexibility of the LED lamp 10. In particular, since the light module 14 and electronics module 16 may be independently decoupled from the heat sink 12, the LED lamp 10 consistent with the present disclosure may be used with numerous combinations of light modules 14 and/or electronic modules 16. For example, the LED lamp 10 may be used with isolated drivers or non-isolated drivers. Additionally, the LED lamp 10 may be easily repaired in the event that either the light module 14 and/or electronic module 16 fails and/or needs replacement. The electrical interconnector 18 may also be removed from the LED lamp 10, thereby providing further design flexibility. The electrical interconnector 18 may provide a common interface for the light module 14 and electronic module 16, thereby increasing the compatibility various light modules 14 (for example, light modules 14 having different types of LEDs with different mounting interfaces (e.g., but not limited to, ceramic based LED and metal base LED with various types of printed circuit boards (PCBs) (such as, but not limited to, FR-4 boards and metal core PCBs, which have different soldering interfaces).

Turning now to FIGS. 3-6, various views of a heat sink 12 consistent with at least one embodiment of the present disclosure are generally illustrated. The heat sink 12 includes one or more structures configured to transfer heat generated by the light module 14 and/or electronics module 16 to a fluid medium, such as air or liquid. The heat sink 12 is constructed from a material such as, but not limited to, aluminum, copper, or an alloy thereof. The size, shape, and configuration of the heat sink 12 may depend on the intended application (e.g., the desired amount of heat to be transferred). The size and arrangement of heat sink 12 is chosen to maintain the LEDs of light module 14 at an appropriate operating temperature.

The heat sink 12 includes, for example, a plurality of heat-radiating fins 22 configured to increase the surface area of the heat sink 12 and dissipate more heat from the light module 14 and/or electronics module 16 to the surrounding air. The heat-radiating fins 22 are disposed generally longitudinally, and include, but are not limited to, straight fins and/or flared fins. It should be appreciated, however, that this is only one example and that the heat sink 12 may include other types of heat radiating/dissipating structures.

Figure 13:
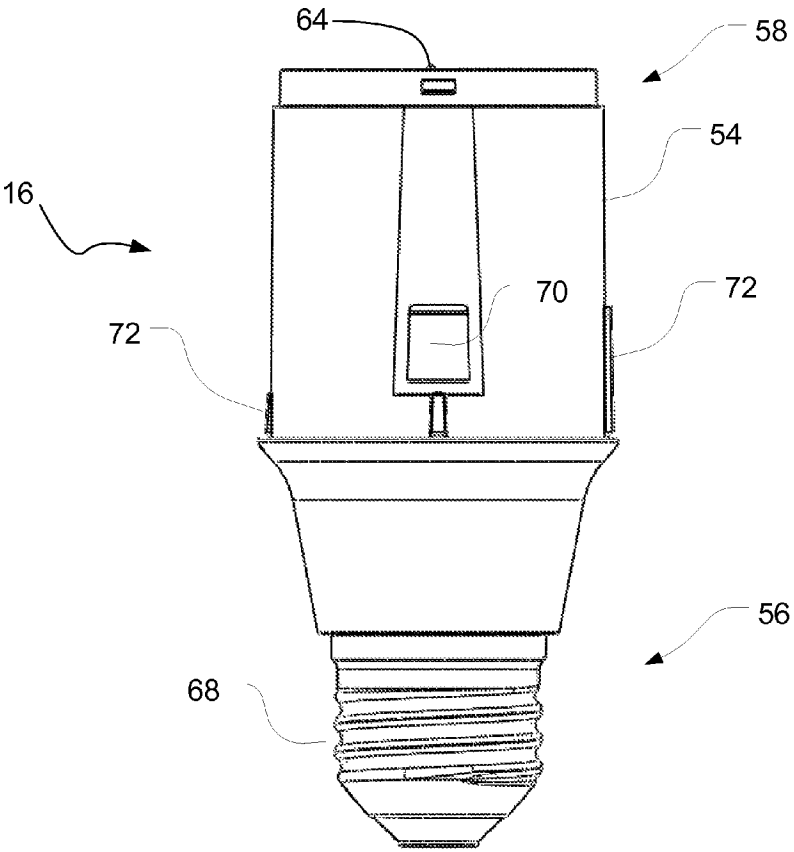
FIG. 13 generally illustrates a side view of the electronics module of FIG. 1.

The heat sink 12 includes a first and a second region 24, 26. The first region 24 is configured to receive at least a portion of the electronics module 16. According to one embodiment, the first region 24 may form a generally cylindrical cavity having dimensions closely matching a portion of the electronics module 16 (e.g., to increase heat transfer from the electronics module 16 into the heat sink 12). The first region 24 may include a locking feature configured to cooperate with the electronics module 16 to couple, mount, or otherwise secure the electronics module 16 to the heat sink 12. The locking feature may include, but is not limited to, a groove or slot 28 configured to engage with a corresponding locking feature on the electronics module 16 (e.g., a tab or protrusion 72 as illustrated in FIG. 13) in a locking fashion. As illustrated, the tab or protrusion 72 may be initially received in the groove or slot 28, urged towards the base of the first region 24, and rotated with respect to the first region 24 to secure the electronics module 16 within the first region 24 of the heat sink 12. It should be appreciated, however, that this is only one embodiment and that the present disclosure may encompass other mechanisms for coupling, mounting, or otherwise securing the electronics module 16 within the first region 24 of the heat sink 12. For example, the electronics module 16 and the first region 24 may include snap connections, threaded connections, interference connections, screws (e.g., a set screw), bolts, clamps, fasteners, and the like. Optionally, the heat sink 12 may include one or more holes or apertures 25. The hole 25 may be disposed adjacent to the blind latch (described herein) in a position wherein the electronics module 16 is coupled to the heat sink 12. The hole 25 may permit access to the blind latch for removal thereof (using a removal spring tool, for example, as described in U.S. Pat. No. 4,840,222 (Lakin), which is incorporated herein by reference).

The second region 26 of the heat sink 12 is configured to receive at least a portion of the light module 14. According to one embodiment, the second region 26 may form a cavity having dimensions closely matching a portion of the light module 14 (e.g., to increase heat transfer from the light module 14 into the heat sink 12). While the second region 26 is illustrated defining a generally cylindrical cavity, the second region 26 may define non-cylindrical cavities.

The second region 26 may include a base 30. According to one embodiment, the first and second regions 24, 26 may be disposed at generally opposite ends of the heat sink 12 and may be separated by the base 30 of the second region 26. The second region 26 may be configured to receive the light module 14 such that a portion of the light module 14 engages the base 30 to facilitate heat transfer from the light module 14 into the base 30 of the heat sink 12. For example, the light module 14 may be in direct contact with the base 30, however, a thermal interface material (not shown for clarity) may be provided between the light module 14 and the base 30. The thermal interface material ensures that the light module 14 remains in thermal contact with the second region 26 of the heat sink 12 with reasonable shock and vibration by minimizing any potential air gaps between the light module 14 and the second region 26 of the heat sink 12.

The second region 26 may include a locking feature configured to cooperate with the light module 14 to couple, mount, or otherwise secure the light module 14 to the heat sink 12. The locking feature may include, but is not limited to, the optical cover 20 (see FIGS. 1 and 2), a groove or slot configured to engage with a corresponding locking feature on the light module 14 (e.g., a tab or protrusion, not shown) in a locking fashion, snap connections, threaded connections, interference connections, screws (e.g., a set screw), bolts, clamps, or other fasteners (not shown); screws can be received through the three holes (unnumbered) on the periphery of cover 20 into corresponding tapped holes see in FIG. 5 on heat sink 12.

The heat sink 12 also includes a passageway 32 extending between the first and second regions 24, 26. According to one embodiment, the passageway 32 may be formed on an interior of the heat sink 12, for example, the passageway 32 extends through the base 30. As described herein, the passageway 32 is configured to at least partially receive a portion of the electrical interconnector 18 (as described herein). For the sake of clarity, upper portion 18*a* of the electrical interconnector 18 (which may extend through passageway 32) has been omitted from FIG. 3.

Turning now to FIGS. 7-10, various views of a light module 14 consistent with at least one embodiment of the present disclosure are generally illustrated. The light module 14 includes at least one light emitting diode (LED) 34, an optical element 36 in register with the LED 34 adapted to shape light emitted from the LED 34, and an electrical connector 38. For example, the light module 14 may include a body or housing 40 configured to be at least partially received within the second region 26. As described herein, the body 40 may be configured to engage the second region 26 to facilitate the transfer of heat from the light module 14 to the heat sink 12.

The body 40 may include an upper portion 42 and a lower portion 44, which may be configured to be coupled, mounted, or otherwise secured together which may be removably attached and detached from the heat sink 12 (e.g., by a user) without damage to the light module 14. The body 40 may be made from an optically reflective plastic material to increase the optical performance of the light module 14. The body 40 may be made as a plastic part that is, subsequent to molding, metalized so as to be reflective or coated with reflective white paint on the upper planar surface adjacent to optical elements 36 and/or on surfaces adjacent to lateral flanks of optical elements 36. An example of a suitable plastic is a polycarbonate marketed by Bayer MaterialScience under the trade name Makrolon 6265. Optionally, the body 40 may include one or more mechanical interfaces 43 (e.g., best seen in FIGS. 9 and 10) configured to engage a corresponding mechanical interface of the heat sink 12 to align the light module 14 with respect to the second region 26 of the heat sink 12. Examples of mechanical interfaces may include, but are not limited, to tabs, protrusion, slots, grooves, keys, and the like. While the illustrated embodiment shows the upper and lower portions 42, 44 secured together using a plurality of fasteners (e.g., screws or bolts) 45, it should be understood that the upper and lower portions 42, 44 may be secured using any mechanism (such as, but not limited to, welding, adhesives, clamps, threaded connections, snap fits, interference fits, and the like). The upper portion 42 may be configured to be coupled, mounted, or otherwise secured to the optical element(s) 36.

The lower portion 44 may be configured to be coupled, mounted, or otherwise secured to LEDs 34. For example, the LEDs 34 may be mounted to a printed circuit board (PCB) 46 (which may be disposed within an interior space 51 defined by the body 40). The PCB 46 may include, but is not limited to, a Flame Retardant Class 4 (FR-4) PCB or a metal core PCB. In the event that a metal core PCB is used, the metal core PCB may serve as the lower portion 44 (i.e., the lower portion 44 and the metal core PCB 46 may be one in the same). For example, the upper and lower portions 42, 44, when coupled together, may define an interior space or cavity configured to at least partially receive the LEDs 34 and/or the PCB 46.

The light module 14 includes one or more LEDs 34 which may be coupled to a printed circuit board (PCB) 46. For example, the LEDs 34 may be arranged in one or more arrays of LEDs 34 that may be simultaneously and/or independently controlled. The three LEDs 34 may include any semiconductor light source such as, but not limited to, conventional high-brightness semiconductor LEDs, organic light emitting diodes (OLEDs), bi-color LEDs, tri-color LEDs, polymer light-emitting diodes (PLED), electro-luminescent strips (EL), etc. The LEDs 34 may include, but are not limited to, packaged and non-packaged LEDs, chip-on-board LEDs, as well as surface mount LEDs. The LEDs 34 may also include LEDs with phosphor or the like for converting energy emitted from the LED to a different wavelength of light.

The PCB 46 may include controller circuitry 48. The controller circuitry 48 may be configured to receive one or more control signals, for example, from electronics module 16 as described herein. The control circuitry 48 may control various attributes of the light module 14, for example, the brightness (e.g., a dimmer circuitry) of the LEDs 34, color of the light emitted from the light module 14 (e.g., the light module 14 may include two or more LEDs 34 configured to emit light having different wavelengths, wherein the controller circuitry 48 may adjust the relative brightness of the different LEDs 34 in order to change the mixed color from the light module 14), adjust for changes in ambient lighting conditions (e.g., an ambient light sensor), adjust for temperature changes, adjust for changes in output due to lifetime changes, and the like.

As discussed above, the light module 14 also includes electrical connector 38. The electrical connector 38 is electrically coupled to the LEDs 34, for example, by the PCB 46, and maybe configured to transfer power and/or control signals from the electronics module 16 to the PCB 46 and/or LEDs 34. The electrical connector 38 may include any type of reusable electrical connector such as, but not limited to, battery connectors, resilient metallic tabs, spring loaded connectors/terminals, pins, sockets, locking connectors, terminal blocks, posts, blade connectors, ring and spade connectors, Universal Serial Bus (USB) connectors, and the like. The electrical connector 38 may be at least partially exposed from the body 40, for example, through aperture or opening 50 (which may be located in the upper and/or lower portions 42, 44) disposed along the peripheral region of the body 40 such that the electrical connector 38 may selectively attachably and detachably form an electrical connection to portions of the electrical interconnector 18 as described herein. The number and arrangement of the connectors in the electrical connector 38 may depend on the number of LEDs 34 and/or necessary control signals for the desired functionality (e.g., dimming, color selecting, etc.).

The optical elements 36 may include an off-the shelf lens or a specially designed lens. The optical element 36 may be integrally molded with the upper portion 42 of the body 40, or may be separately formed and coupled, mounted, or otherwise secured to the body 40. The optical element 36, such as a T.I.R. (total internal reflectance) lens, may be configured to be in a fixed position with respect to the body 40 or may be moveable such that light emitted from a LED 34 may be directed/aimed by a user.

Optionally, the light module 14 may include a thermal interface material 52 configured to be arranged between the lower portion 44 and the base 30 of the second region 26 of the heat sink 12. The thermal interface material 52 may ensure that the light module 14 remains in thermal contact with the second region 26 of the heat sink 12 with reasonable shock and vibration by minimizing any potential air gaps between the light module 14 and the second region 26 of the heat sink 12.

Figure 11:
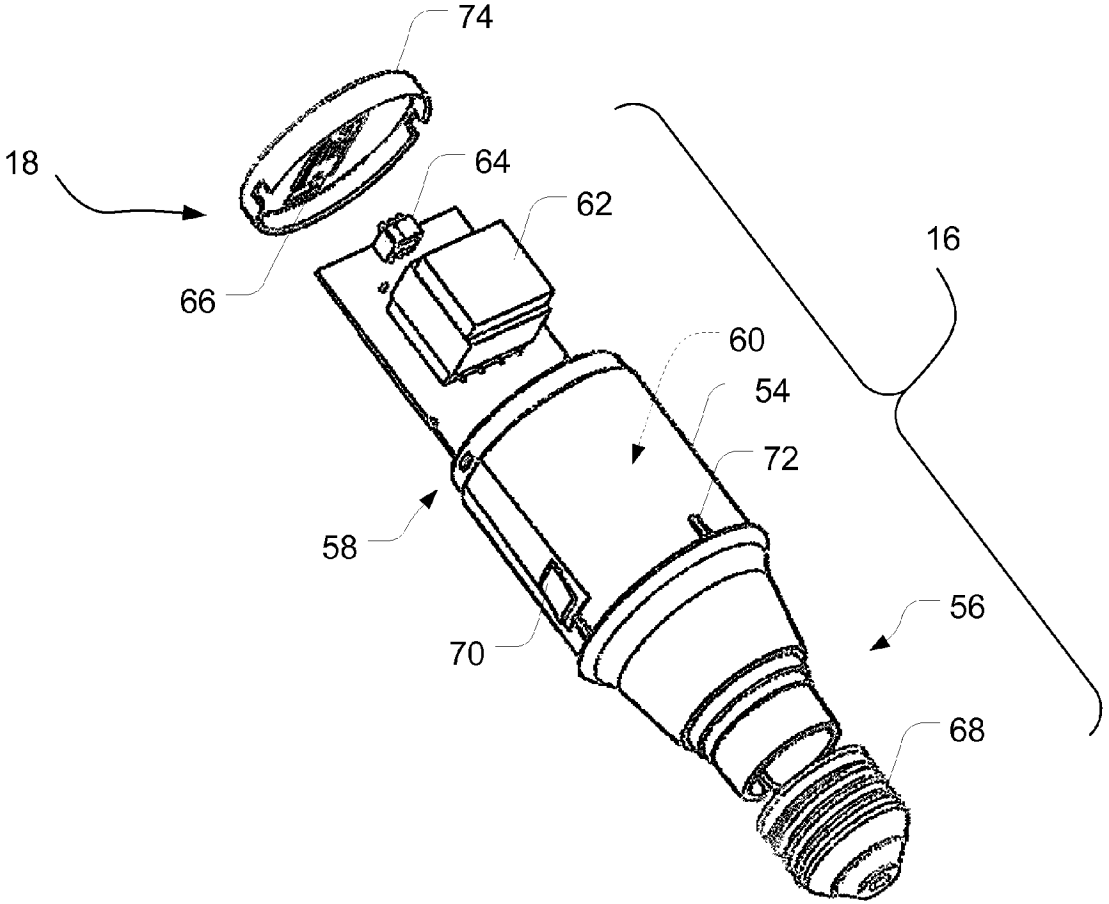
FIG. 11 generally illustrates an exploded view of the electronics module and electrical interconnector of FIG. 1.
Figure 12:
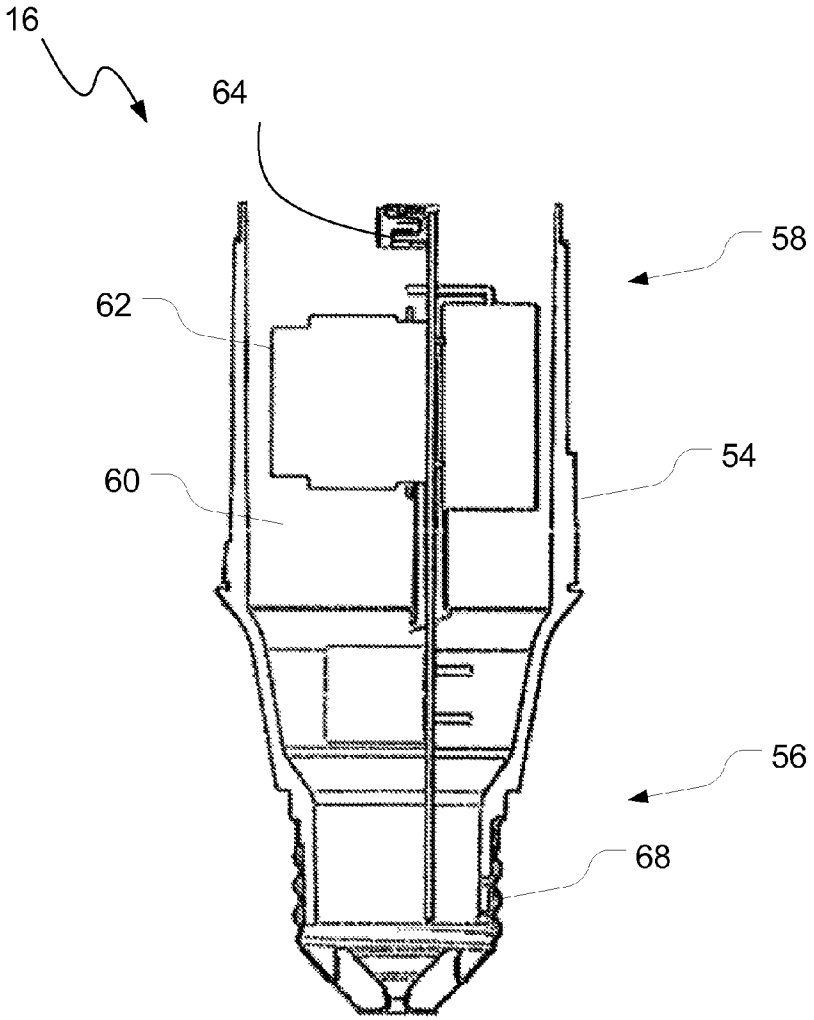
FIG. 12 generally illustrates a cross-sectional side view of the electronics module of FIG. 1.
Figure 14:
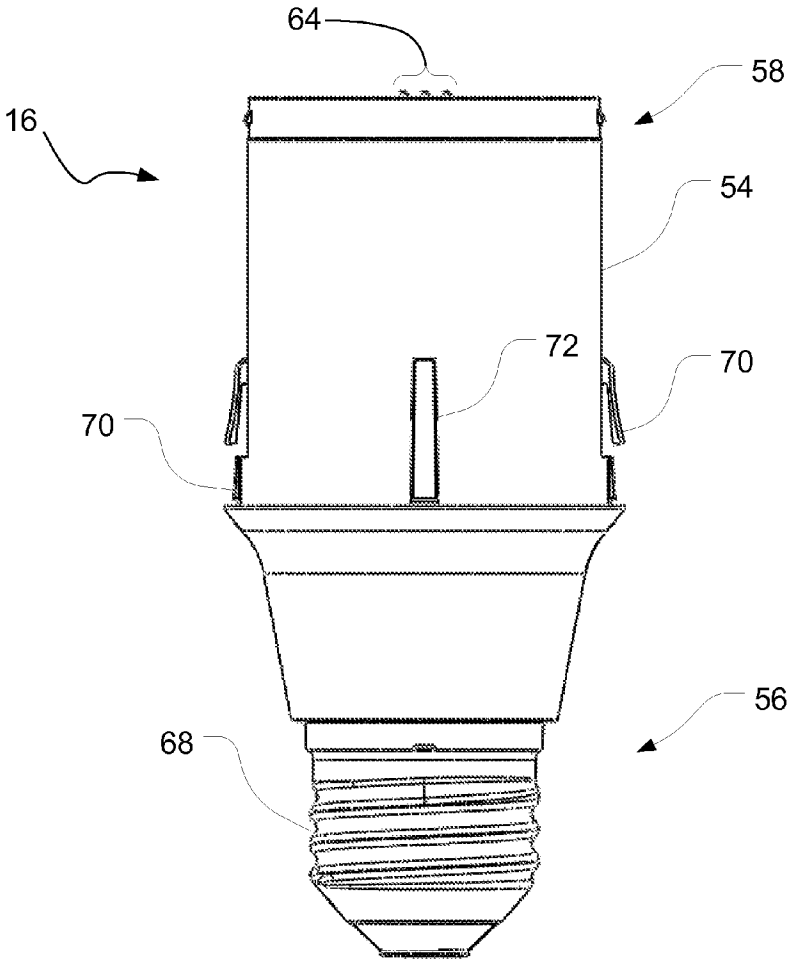
FIG. 14 generally illustrates another side view of the electronics module of FIG. 1.

Turning now to FIGS. 11-14, FIG. 11 generally illustrates an exploded view of one embodiment of an electronics module 16 and an electrical interconnector 18 and FIGS. 12-14 generally illustrate various views of one embodiment of an electronics module 16. As may be appreciated, while the electrical interconnector 18 is shown separated from heat sink 12, in practice the electrical interconnector 18 is configured to extend at least partially through the passageway 32 of the heat sink 12 (see, for example, FIG. 2).

The electronics module 16 includes a housing 54 having a first end region 56, a second end region 58, and an interior space or cavity 60 (e.g., best illustrated in FIG. 12) configured to at least partially receive control circuitry 62. The control circuitry 62 may be configured to convert an AC signal into a DC signal at a desired current and voltage, and/or generate one or more control signals to adjust the operation of the light module 14, for example, the brightness (e.g., a dimmer circuitry) of the LEDs 34, color of the light emitted from the light module 14 (e.g., the light module 14 may include two or more LEDs 34 configured to emit light having different wavelengths, wherein the controller circuitry 48 may adjust the relative brightness of the different LEDs 34 in order to change the mixed color from the light module 14), adjust for changes in ambient lighting conditions (e.g., an ambient light sensor), adjust for temperature changes, adjust for changes in output due to lifetime changes, and the like. The control circuitry 62 includes a first electrical connector 64 configured to selectively attachably and detachably form an electrical connection to portions of the electrical interconnector 18 (e.g., first and second electrical contacts 66 as described herein).

The first end region 56 is configured to be electrically and/or mechanically coupled to an external power supply (e.g., an electrical socket coupled to an AC or DC power source, not shown). While the first end region 56 is illustrated having a threaded socket 68, it should be appreciated that the first end region 56 may have any electrical connector configured to make a removable electrical connection with a source of electrical power, such as a conventional Edison screw base or a GU-24 pin base.

At least a portion of the second end region 58 is configured to be coupled, mounted, or otherwise secured to the first region 24 of the heat sink 12. For example, the housing 54 may include one or more coupling structures 70 configured to selectively attachably and detachably retain the electronics module 16 to the heat sink 12. According to one embodiment, the coupling structure 70 may include a latch. For example, the latch may include blind latch. According to another embodiment, the coupling structure 70 may include a snap-fit structure. The coupling structure 70 may be spaced from the first electrical connector 64.

Figure 4:
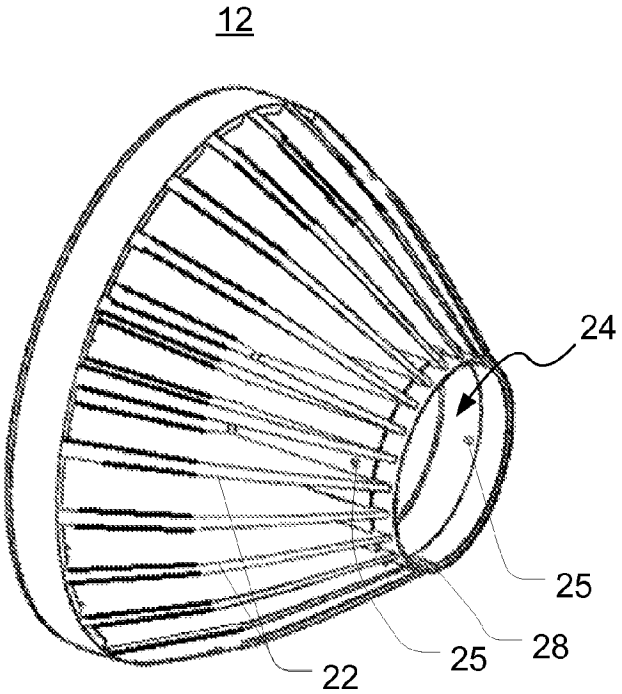
FIG. 4 generally illustrates a rear perspective view of the heat sink of FIG. 1.
Figure 3:
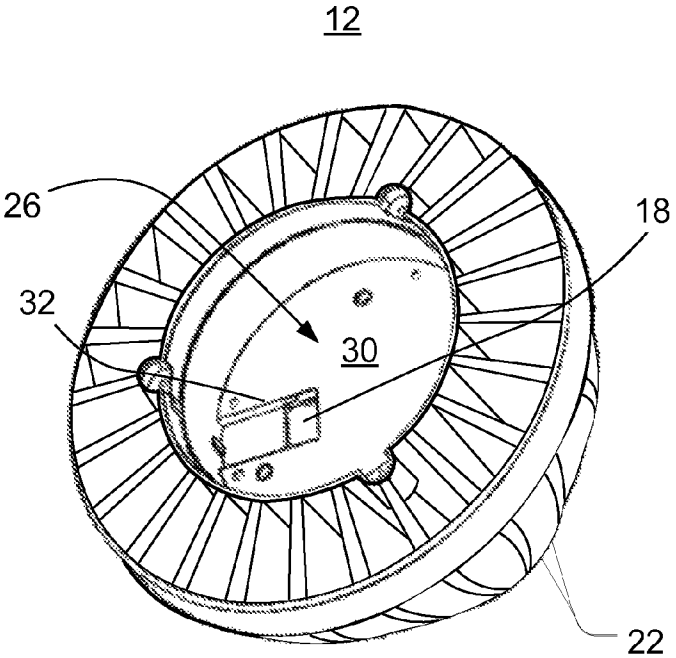
FIG. 3 generally illustrates a front perspective view of the heat sink of FIG. 1.
Figure 6:
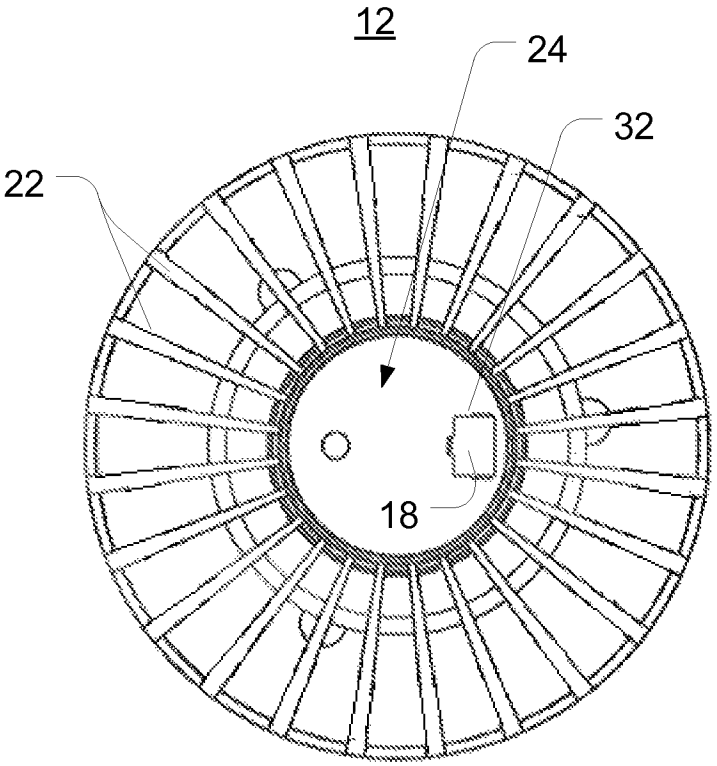
FIG. 6 generally illustrates a rear view end of the heat sink of FIG. 1.
Figure 5:
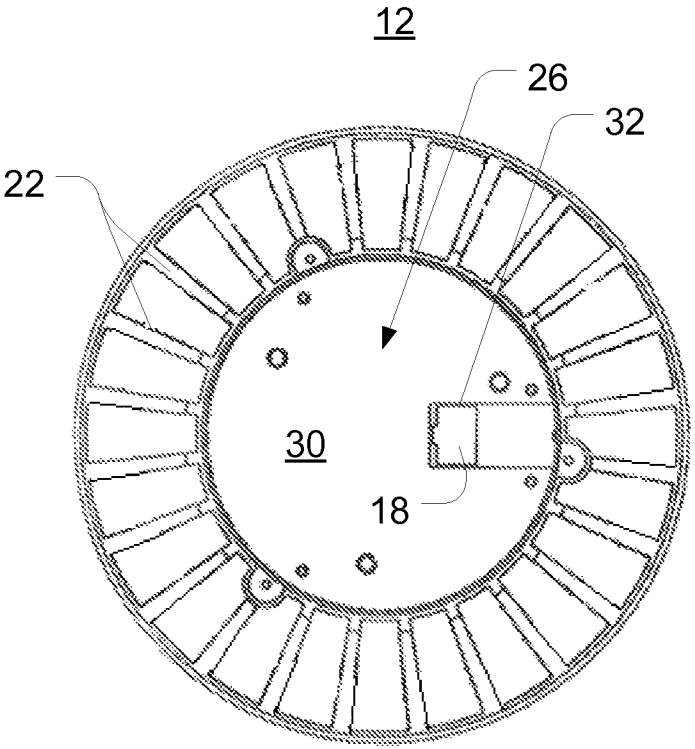
FIG. 5 generally illustrates a front view end of the heat sink of FIG. 1.
Figure 7:
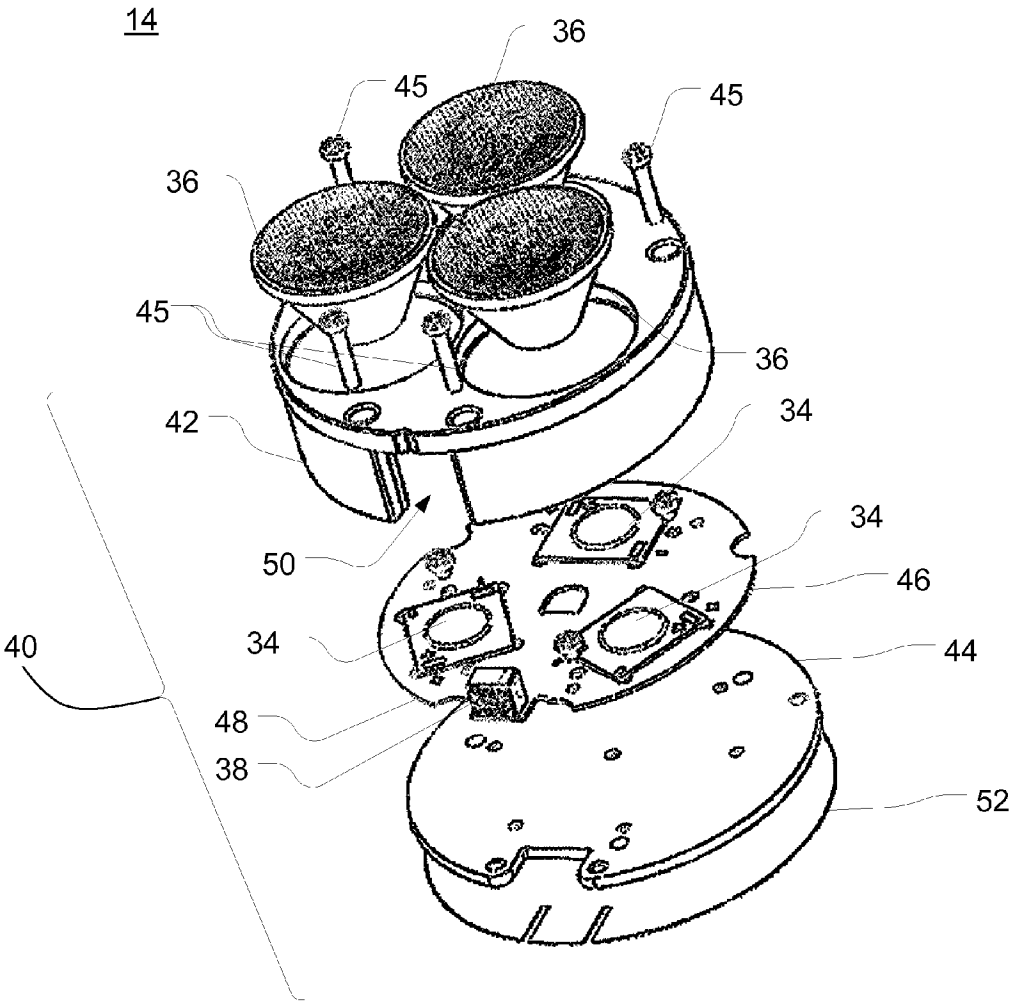
FIG. 7 generally illustrates an exploded view of the light module of FIG. 1.
Figure 8:
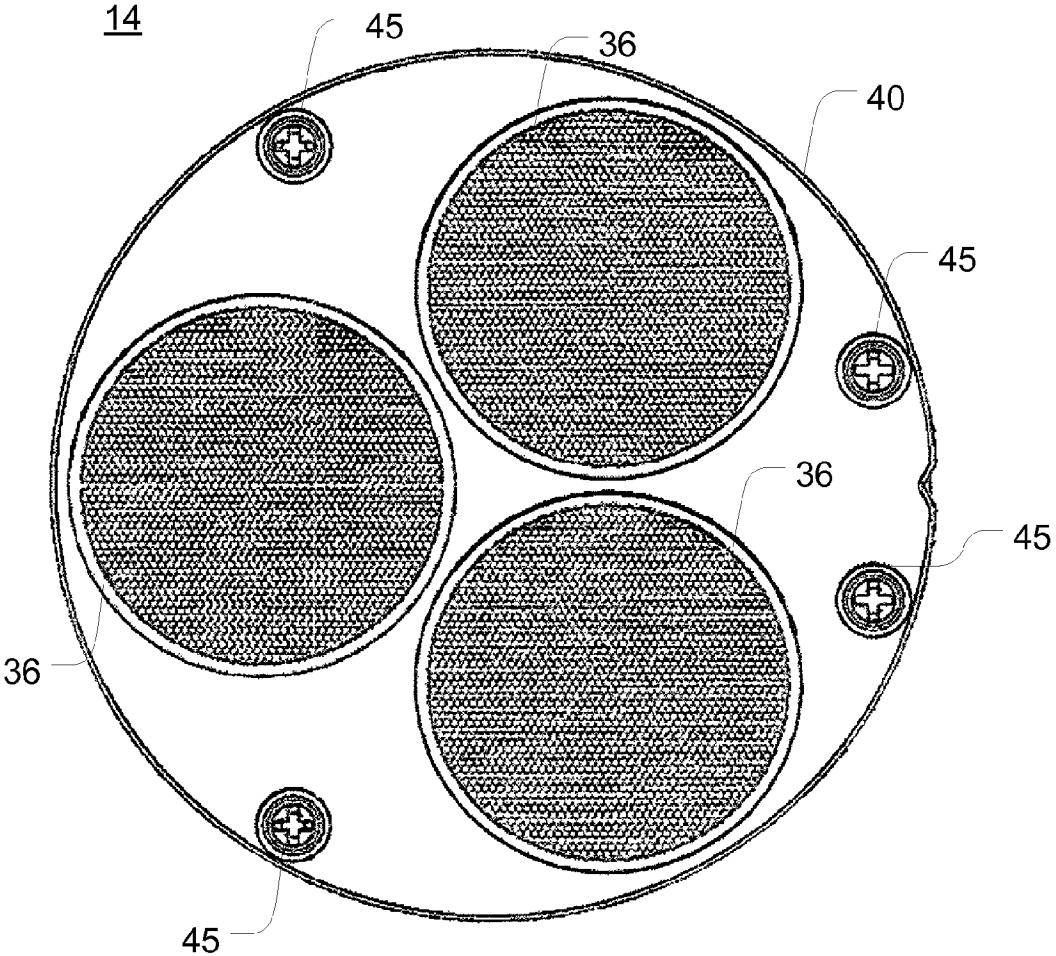
FIG. 8 generally illustrates a front view end of the light module of FIG. 1.
Figure 9:
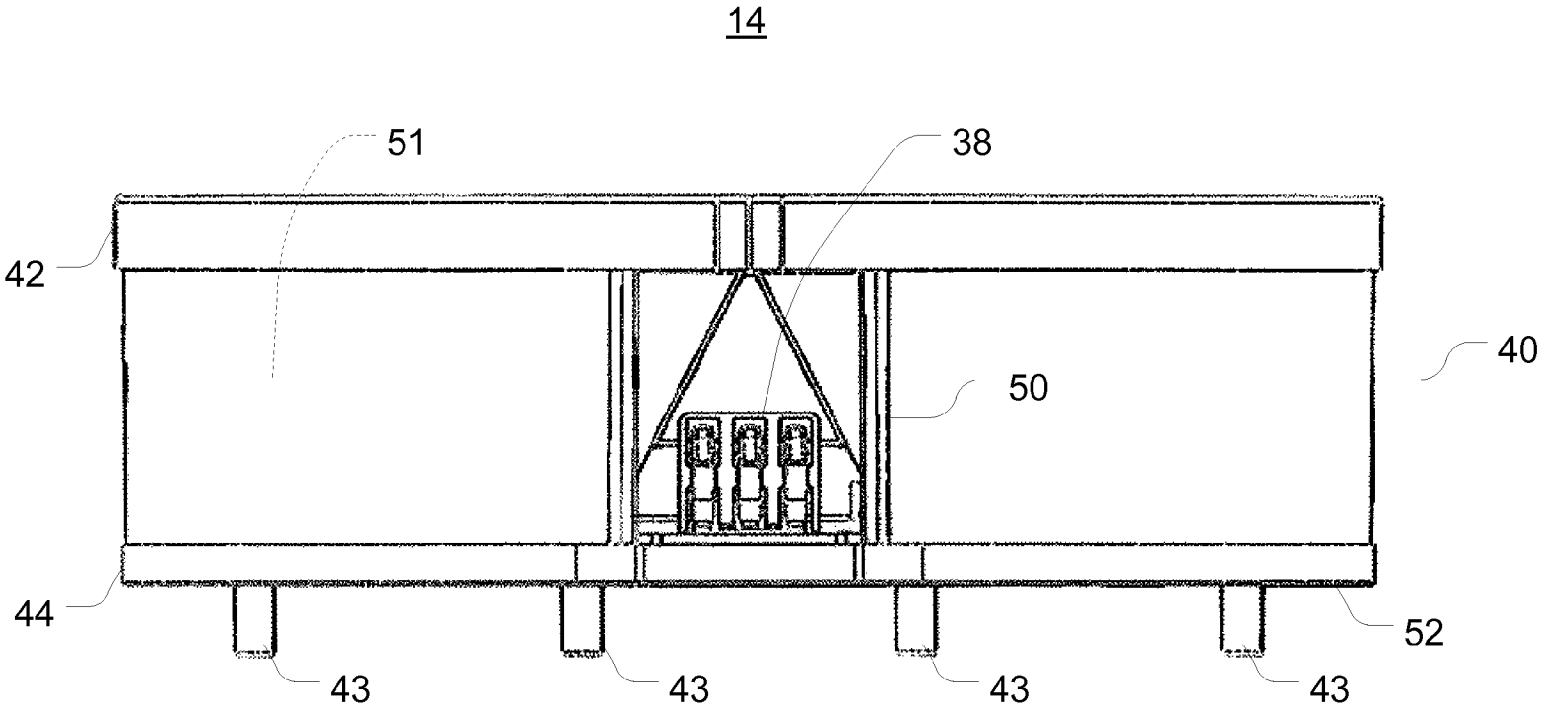
FIG. 9 generally illustrates a side view of the light module of FIG. 1.
Figure 10:
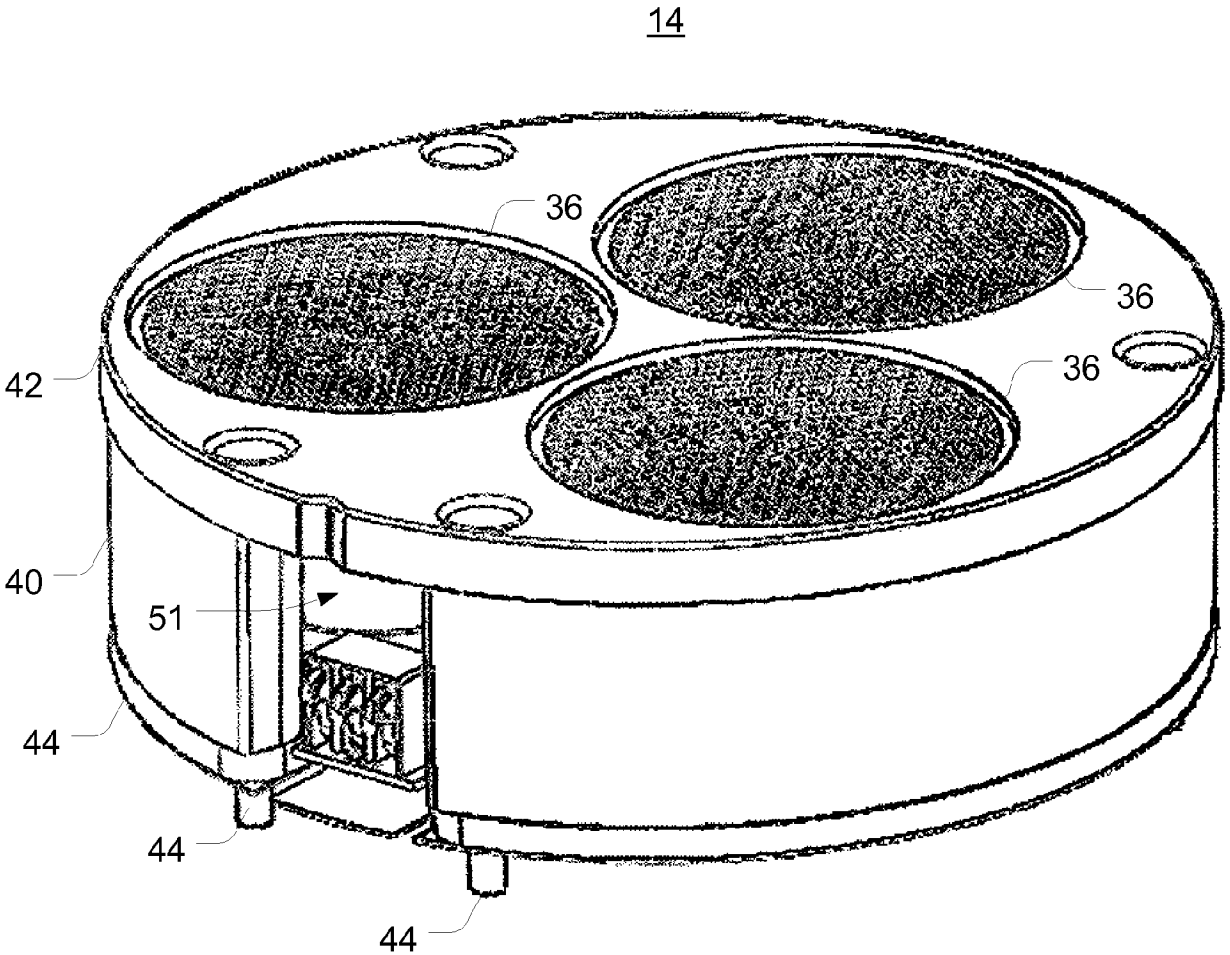
FIG. 10 generally illustrates a perspective side view of the light module of FIG. 1.

The housing 54 of the electronics module 16 and/or the first region 24 of the heat sink 12 may include a guideway structure configured to align the electronics module 16 within the first region 24 such that the first electrical connector 64 is aligned with the first and second electrical contacts 66 of the electrical interconnector 18 to effect an electrical connection between therebetween (for example, as generally illustrated in FIG. 2). For example, the housing 54 may include one or more locking features (e.g., tabs or protrusions 72) configured to engage with corresponding locking features of the heat sink 12 (e.g., slots or grooves 28 as shown in FIG. 4). As illustrated, the tab or protrusion 72 may be initially received in the groove or slot 28 of the first region 24, urged towards the base of the first region 24, and rotated with respect to the first region 24 to secure the electronics module 16 within the first region 24 of the heat sink 12 and align the first electrical connector 64 with the first and second electrical contacts 66 of the electrical interconnector 18 to effect an electrical connection between therebetween. It should be appreciated, however, that this is only one embodiment and that the present disclosure may encompass other mechanisms for coupling, mounting, or otherwise securing the electronics module 16 within the first region 24 of the heat sink 12. For example, the electronics module 16 and the first region 24 may include snap connections, threaded connections, interference connections, screws (e.g., a set screw), bolts, clamps, and the like.

Turning now to FIGS. 2 and 11, one embodiment of the electrical interconnector 18 is generally illustrated. The electrical interconnector 18 is configured to be disposed at least partially within passageway 32 (see, for example, FIGS. 3-5) of the heat sink 12 such that the electrical interconnector 18 extends at least partially between the first and second regions 24, 26 of the heat sink 12. According to one embodiment, the passageway 32 may extend through the base 30. The electrical interconnector 18 includes at least a first and second electrical contact 66 extending between the first and second regions 24, 26 of the heat sink 12. The first and second electrical contacts 66 may be exposed within each of the first and second regions 24, 26 and adapted for making selectively attachable and detachable electrical connections in both the first and second regions 24, 26 with the light module 14 and electronics module 16. One or more of the first and second electrical contacts 66 may include any type of reusable electrical connector such as, but not limited to, jack-type connections, resilient metallic tabs, battery connectors, spring loaded connectors/terminals, pins, sockets, locking connectors, terminal blocks, posts, blade connectors, ring and spade connectors, Universal Serial Bus (USB) connectors, and the like.

Figure 15:
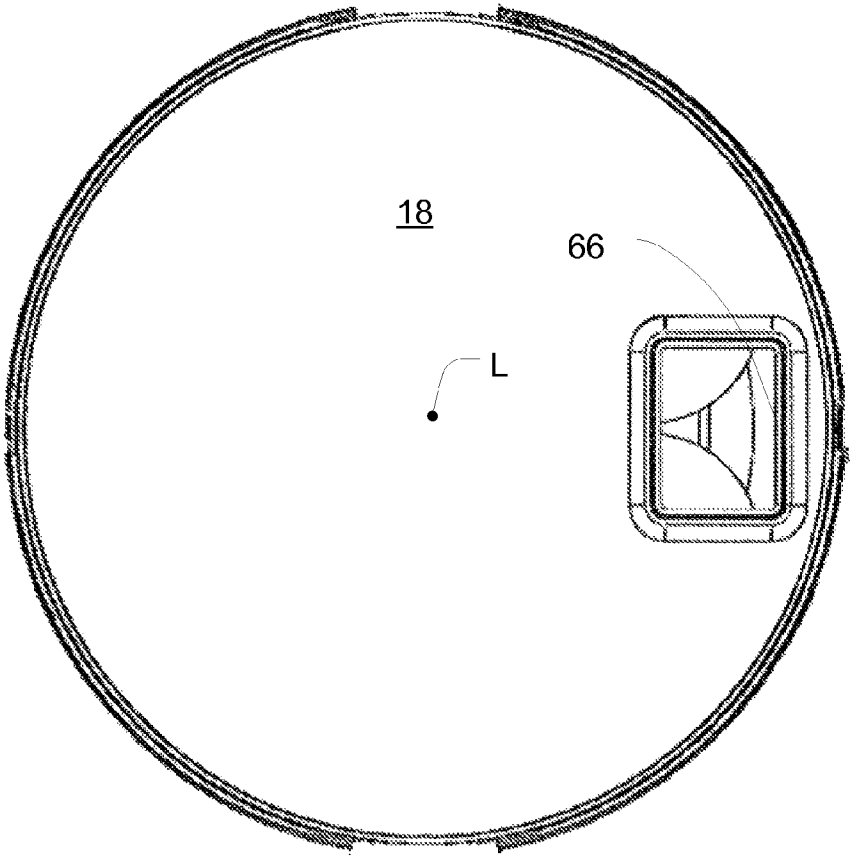
FIG. 15 generally illustrates a top end view of another embodiment of the electrical interconnector.

As discussed herein, the electrical interconnector 18 may include an upper portion 18*a* and a lower portion 18*b* (see, for example, FIG. 1A), which may each include a portion of the first and second electrical contacts 66 (e.g., one or more of the connectors described herein). For example, the upper portion 18*a* may be configured to align a first set of connectors of the first and second electrical contacts 66 within the passageway 32 and the second region 26. Similarly, the lower portion 18*b* may be configured to align a second set of connectors of the first and second electrical contacts 66 within the passageway 32 and the first region 24. It should be understood, however, that this is only one embodiment and that the electrical interconnector 18 may include less than or more than two components. For example, FIG. 15 generally illustrates another embodiment of an electrical interconnector 18 formed as an integral component (e.g., upper portion 18*a* and lower portion 18*b* may be a unitary component) which is configured to extend through at least a portion of the passageway 32 between the first and second regions 24, 26.

The electrical contacts 66 may be at least partially exposed from a body 74. The body 74 electrically insulates the electrical interconnector 18 from any metal components (such as, but not limited to, the heat sink 12) and/or may facilitate alignment of the electrical interconnector 18 with the passageway 32 such that the electrical connector 38, 64 of the light module 14 and electronics module 16 (respectively) may selectively attachably and detachably form an electrical connection to the electrical contacts 66 of the electrical light module 18 as described herein. The number and arrangement of the connectors in the electrical connectors 38, 64, 66 may depend on the number of LEDs 34 and/or necessary control signals for the desired functionality (e.g., dimming, color selecting, etc.). According to one embodiment, the electrical contacts 66 may be spaced radially from a central longitudinal axis L (see, for example, FIG. 15), thereby defining a guideway structure assisting alignment of at least one of the light module 14 and the electronics module 16 during attachment to the heat sink 12.

According to another embodiment, the electrical interconnector 18 can be eliminated and the light module 14 may be selectively electrically attached and detached (i.e., removably coupled) to the electronics module 16 directly through the passageway 32.

Accordingly, the present disclosure a LED lamp includes a heat sink, an electrical interconnector, an electronics module, and a light module. The heat sink defines a first region adapted to receive in operative electrical and mechanical association an electronics module and a second region adapted to receive in operative electrical and mechanical association a light module. The heat sink further defining a passageway extending between the first region and the second region. The electrical interconnector is disposed in the passageway and has at least first and second electrical contacts extending between the first region and the second region, the first and second contacts being exposed within each of the first and second regions and adapted for making selectively attachable and detachable electrical connection in both the first and second regions. The electronics module adapted to be, as a unit, received in and selectively replaceably detached from the first region, the electrical module including a socket adapted to make electrical connection to an external power source, control circuitry adapted to receive power from the power source and provide power to light emitting diodes (LEDs), a coupling structure adapted to selectively attachably and detachably retain the electronics module to the heat sink, and a first electrical connector adapted to selectively attachably and detachably form an electrical connection to portions of the first and second contacts in the first region. The light module is adapted to be, as a unit, received in and selectively replaceably detached from the second region. The light module includes at least one light emitting diode (LED), an optical element in register with the LED adapted to shape light emitted therefrom, and a second electrical connector in operative association with the at least one LED and adapted to selectively attachably and detachably form an electrical connection to portions of the first and second contacts in the second region. The electronics module when retained in the first region supplies power to the light module when retained in the second region.

As used in any embodiment herein, "circuitry" may comprise, for example, singly or in any combination, hardwired circuitry, programmable circuitry, state machine circuitry, and/or firmware that stores instructions executed by programmable circuitry. In at least one embodiment, the light module and/or electronics module may include a controller, photodetector, PWM circuitry and/or driver circuitry (not shown) that may collectively or individually comprise one or more integrated circuits. An "integrated circuit" may be a digital, analog or mixed-signal semiconductor device and/or microelectronic device, such as, for example, but not limited to, a semiconductor integrated circuit chip.

As used herein, the designation (1)-(n) in connection with reference numerals should be interpreted as a repetition of like components (which may be identical, similar, or different). The terms "first," "second," and the like herein do not denote any order, quantity, or importance, but rather are used to distinguish one element from another, and the terms "a" and "an" herein do not denote a limitation of quantity, but rather denote the presence of at least one of the referenced item.

The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals.

Reference in the specification to "one embodiment" or "an embodiment" of the present disclosure means that a particular feature, structure or characteristic described in connection with the embodiment is included in at least one embodiment of the present disclosure. Thus, the appearances of the phrase "in one embodiment" appearing in various places throughout the specification are not necessarily all referring to the same embodiment.

While the principles of the present disclosure have been described herein, it is to be understood by those skilled in the art that this description is made only by way of example and not as a limitation as to the scope of the invention. The features and aspects described with reference to particular embodiments disclosed herein are susceptible to combination and/or application with various other embodiments described herein. Such combinations and/or applications of such described features and aspects to such other embodiments are contemplated herein. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

The following is a non-limiting list of reference numeral used in the specification:

10 LED lamp
12 heat sink
14 light module
16 electronics module
18 electrical interconnector
20 optical cover
22 heat-radiating fins
24 first region
25 hole
26 second region
28 groove/slot
30 base
32 passageway
34 LED
36 optical element
38 electrical connector
40 body/housing
42 upper portion
43 mechanical interfaces
44 lower portion
45 fasteners
46 printed circuit board (PCB)
48 controller circuitry
50 aperture/opening
51 interior space
52 thermal interface material
54 body/housing
56 first end region
58 second end region
60 interior space/cavity
62 control circuitry
64 electrical connector
66 first and second electrical contacts
68 socket
70 coupling structures
72 tabs/protrusions
74 body
L central longitudinal axis

We claim:

1. An LED lamp (10) comprising:

a) a heat sink (12), said heat sink (12) defining a first region (24) adapted to receive in operative electrical and mechanical association an electronics module (16) and a second region (26) adapted to receive in operative electrical and mechanical association a light module (14), said heat sink (12) further defining a passageway (32) extending between said first region (24) and said second region (26);

b) an electrical interconnector (18) disposed in said passageway (32) and having at least first and second electrical contacts (66) extending between said first region (24) and said second region (26), said first and second contacts (66) being exposed within each of said first and second regions (24, 26) and adapted for making selectively attachable and detachable electrical connection in both said first and second regions (24, 26);

c) an electronics module (16) adapted to be, as a unit, received in and selectively replaceably detached from said first region (24), said electrical module (16) comprising i) a socket (68) adapted to make electrical connection to an external power source;

ii) control circuitry (62) adapted to receive power from the power source and provide power to light emitting diodes (LEDs) (34);

iii) a coupling structure (70, 72) adapted to selectively attachably and detachably retain said electronics module (16) to said heat sink (12); and iv) a first electrical connector (64) adapted to selectively attachably and detachably form an electrical connection to portions of said first and second contacts (66) in said first region (24); and d) a light module (14) adapted to be, as a unit, received in and selectively replaceably detached from said second region (26), said light module (14)comprising: i) at least one light emitting diode (LED) (34); (ii) an optical element (36) in register with the LED (34) adapted to shape light emitted therefrom; and iii) a second electrical connector (38) in operative association with said at least one LED (34) and adapted to selectively attachably and detachably form an electrical connection to portions of said first and second contacts (66) in said second region (26), wherein the electronics module (16) when retained in the first region (24) supplies power to the light module (14) when retained in the second region (26).

2. The LED lamp (10) of claim 1, wherein the coupling structure (70, 72) comprises a latch.

3. The LED lamp (10) of claim 1, wherein the coupling structure (70, 72) is spaced from the first electrical connector.

4. The LED lamp (10) of claim 1, wherein the interconnector (18) comprises a jack.

5. The LED lamp (10) of claim 1, wherein a guideway structure (28, 70, 72) is formed on at least one of said electronics module (16) and said light module (14).

6. The LED lamp (10) of claim 1, wherein the interconnector (18) is spaced radially from a central longitudinal axis (L) of the heat sink (12) thereby defining a guideway structure assisting alignment of at least one of said electronics module (16) and said light module (14) during attachment to the heat sink (12).

7. The LED lamp (10) of claim 1, wherein the coupling structure (70, 72) comprises a snap-fit structure.

8. The LED lamp (10) of claim 1, wherein the coupling structure (70, 72) comprises a blind latch.

9. The LED lamp (10) of claim 8, wherein the heat sink (12) further defines a hole (25) adjacent the blind latch in a position wherein the electronics module (16) is coupled to the heat sink (12), said hole (25) permitting access to said blind latch.

10. The LED lamp (10) of claim 1, wherein the optical element (36) comprises a lens.

11. The LED lamp (10) of claim 1, wherein the light module (14) comprises a housing (40) defining an interior space (51), said at least one LED (34) being disposed on a printed circuit board (46) received in the interior space (51), and the second electrical connector (38) is formed at a peripheral region of the housing (40).

12. The LED lamp (10) of claim 1, wherein the light module (14) comprises a plurality of LEDs (34).

13. The LED lamp (10) of claim 1, wherein the passageway (32) is formed on an interior of the heat sink (12).

14. The LED lamp (10) of claim 1, further comprising a removable locking structure (28, 70, 72) affixing said light module (14) to said heat sink (12).

15. The LED lamp (10) of claim 1, wherein the first and second electrical contacts (66) comprise resilient metallic tabs.

* * * * *